US005937526A

United States Patent [19]

Wahl et al.

[11] Patent Number: 5,937,526

[45] Date of Patent: Aug. 17, 1999

[54] ATTACHMENT COMB FOR HAIR CLIPPER

[75] Inventors: Gregory Wahl; Edward Brill, both of Sterling; Scott Melton, Erie, all of Ill.

[73] Assignee: Wahl Clipper Corporation

[21] Appl. No.: 08/996,439

[22] Filed: Dec. 22, 1997

[51] Int. Cl.[6] ..... B26B 19/20

[52] U.S. Cl. ..... 30/201; 30/200

[58] Field of Search ..... 30/200, 201, 233, 30/233.5

[56] References Cited

U.S. PATENT DOCUMENTS

| | | | |
|---|---|---|---|
| 1,869,101 | 7/1932 | Henderson . | |
| 2,544,052 | 3/1951 | Scott . | |
| 2,618,060 | 11/1952 | Giorgi | 30/201 |
| 2,718,696 | 9/1955 | Green | 30/200 |
| 3,041,726 | 7/1962 | Hitson | 30/201 |
| 3,055,376 | 9/1962 | Walls . | |
| 3,149,418 | 9/1964 | Milbourn . | |
| 3,648,370 | 3/1972 | Cercone | 30/201 |
| 3,844,036 | 10/1974 | Wahl et al. | 30/200 |
| 3,988,828 | 11/1976 | Geary | 30/210 |
| 4,532,707 | 8/1985 | Allen | 30/200 |
| 4,622,745 | 11/1986 | Wahl | 30/201 |
| 4,867,184 | 9/1989 | Davis | 132/214 |
| 4,926,891 | 5/1990 | Fani et al. | 132/214 |

OTHER PUBLICATIONS

Oster Specialty Products Brochure, Sunbeam–Oster Company, 1992.

Moser Company Brochure, "The Ideal Accessories for your Moser Hair Clipper."

*Primary Examiner*—Hwei-Siu Payer

*Attorney, Agent, or Firm*—Greer, Burns & Crain, Ltd.

[57] ABSTRACT

An attachment comb for use with a hair clipper that includes a series of teeth with lower peripheral surfaces of a particular curve that are configured for comfortable movement along the surface of a subject's head, and where the teeth are also preferably proportioned in such a manner as to permit the hair to be uniformly trimmed to relatively long lengths of an inch or greater. Specifically, in the present attachment comb, at least one of the teeth preferably includes a widened rib portion that extends along at least a portion of the length of the lower peripheral edge of that tooth. In addition, the lower peripheral surfaces of the teeth are preferably curved into a half-teardrop shape that includes both a concave curved surface and a convex curved surface. Finally, the teeth may be flared outwardly as they extend away from the base portion so that the hair being cut can be directed toward the cutting blades on the hair clipper.

26 Claims, 3 Drawing Sheets

ATTACHMENT COMB FOR HAIR CLIPPER

BACKGROUND OF THE INVENTION

The present invention relates generally to an attachment comb for use with a hair clipper, and more particularly to such an attachment comb that includes multiple teeth, the bottom edges of which are curved and include a widened rib to better distribute the forces used to guide the clipper, which increases the comfort of the hair cutting subject. In addition, the multiple teeth of the attachment comb of the present invention are preferably flared to facilitate the alignment and feeding of the hair, particularly long hair, to the cutting blades of the hair clipper.

In general, most attachment combs presently available include a set of teeth that extend away from the blade area of the hair clipper. These teeth are designed to contact the skin of the head (or other area being cut) to maintain the cutting blades at a relatively fixed distance from the skin, so that the hair may be cut to a uniform length. The bottom edges of the attachment comb are generally pushed along the surface of the scalp, and the teeth guide the hair towards the cutting blades of the clipper. Different attachment combs that maintain the blades at different fixed distances from the skin may be used to cut the hair to different lengths.

Typically, the lower peripheral surfaces of the teeth that contact the skin of the area being clipped are narrow and substantially straight. Thus, only a small area of the straight tooth surface contacts the curved surface of the head of the person whose hair is being clipped. Accordingly, the force used to guide the clipper along the person's head is concentrated at a few relatively small pressure points, which can lead to discomfort for the person whose hair is being clipped.

The mismatch between the relatively straight surface of the teeth and the curved surface of the head of the person receiving a haircut can also make it more difficult to trim the hair to a single uniform length. When the straight tooth surface is placed against the curved head surface, there is a tendency for the hair clipper assembly (which includes a hair clipper and an attachment comb) to be pivoted or "rocked" about the point of contact. This rocking motion varies the spacing of the cutting blades to the head, possibly resulting in the hair being trimmed to several different lengths.

An additional problem with most commonly available attachment combs is that they do not provide a method of adequately cutting hair to relatively long lengths of greater than about one inch. Cutting hair to relatively long lengths requires that the comb adequately lift and support these long lengths of hair. Longer hair also has more of a tendency to be orientated in numerous different directions, and aligning these long strands of hair has been a problem with earlier comb designs. Due to the problems associated with cutting hair to relatively long lengths, most currently available attachment combs are designed to cut the hair to lengths much shorter than one inch, normally in the range of one half to one quarter inch. As effective attachment combs suitable for cutting hair to relatively long lengths are not generally available, cutting the hair to lengths of one inch or greater normally requires either the use of a pair of scissors or the use of a hair clipper and a comb in combination (where the comb is used to lift the hair away from the scalp). When using either of these two methods, it is difficult for persons not professionally trained as barbers or stylists to cut the hair to a uniform length.

Besides the difficulties encountered when attempting to cut hair to a relatively long uniform length, many currently available attachment combs also have difficulty adequately feeding longer hair towards the cutting area of the hair clipper. Also, with many of the currently available attachment combs, there is a relatively high level of resistance encountered by the leading portions of the teeth when the comb is inserted into a patch of hair.

Thus, in view of the problems discussed above, one object of the present invention is to provide an improved attachment comb for use with a hair clipper that is capable of providing more comfort to the person whose hair is being clipped.

An additional object of the present invention is to provide an improved attachment comb with teeth that have a lower peripheral surface that is curved in such a manner as to correspond to the head of the person whose hair is being trimmed, and wherein a more comfortable haircut can be achieved.

A related object of the present invention is to provide an improved attachment comb that is more comfortable for the person whose hair is being trimmed due to the addition of a widened rib on the lower peripheral surface of some, or all, of the teeth.

Another object of the, present invention is to provide an improved attachment comb that enables the hair to be easily cut to a uniform length by reducing the possibility that the hair clipper assembly may be "rocked," which results in the hair being cut to dissimilar lengths.

Yet another object of the present invention is to supply an improved attachment comb with particularly shaped teeth that enable hair to be trimmed to relatively long lengths of one inch or greater.

Still another object of the present invention is to supply an improved attachment comb that facilitates the cutting of longer hair by providing teeth that are flared out from an area near the cutting blades, which helps to better align and guide the hair towards the cutting blades.

Another object of the present invention is to provide an improved attachment comb in which at least some of the teeth are configured with a surface of reduced radius (i.e. an undercut) to minimize the level of resistance encountered by the leading edges of the teeth when the comb is inserted into a patch of hair.

These and other objects of the present invention are discussed or will be apparent from the following detailed description of the present invention.

SUMMARY OF THE INVENTION

Accordingly, the above-listed objects are met or exceeded by the present attachment comb for a hair clipper, wherein the attachment comb includes a series of teeth with lower peripheral surfaces of a particular curve that are configured for comfortable movement along the surface of a subject's head, and where the teeth are also preferably proportioned in such a manner as to permit the hair to be uniformly trimmed to relatively long lengths of an inch or greater.

More specifically, the present invention provides an attachment comb for use with a hair clipper that includes a base portion that is configured and arranged for attaching the attachment comb to a hair clipper, and a plurality of teeth that extend from the base portion. Each of the teeth include a body portion defined between an upper peripheral edge and a lower peripheral edge, whereby the lower peripheral edges of the teeth are configured and arranged to make sliding contact with a head of a person whose hair is being clipped. At least one of the teeth preferably includes a rib portion that extends along at least a portion of the length of the lower peripheral edge of that tooth. In addition, the lower peripheral surfaces of the teeth are preferably curved into a half-teardrop shape that includes both a concave curved surface and a convex curved surface. Finally, the teeth may be flared outwardly as they extend away from the base portion so that the hair being cut can be aligned and directed toward the cutting blades on the hair clipper.

BRIEF DESCRIPTION OF THE DRAWINGS

The above-mentioned and other features of this invention and the manner of obtaining them will become more apparent, and will be best understood by reference to the following description, taken in conjunction with the accompanying drawings in which.

DESCRIPTION OF THE PREFERRED EMBODIMENT

Figure 1:
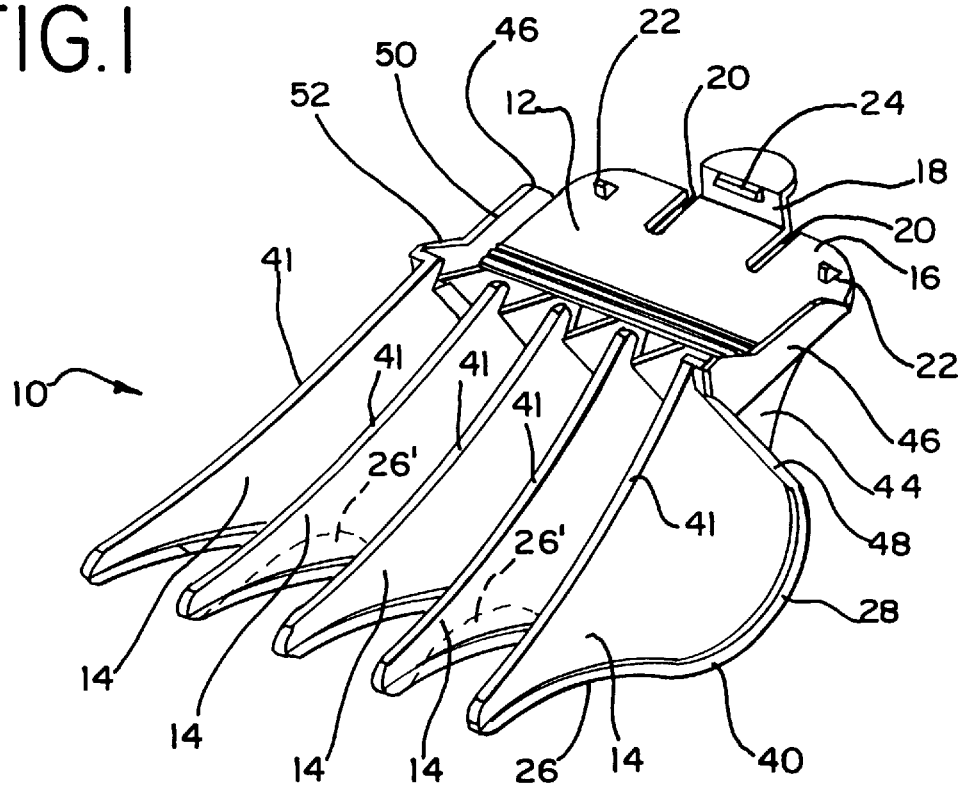
FIG. 1 is a perspective view of the present hair clipper attachment comb.

Referring now to FIGS. 1 through 6, the preferred embodiment of the present hair clipper attachment comb is generally designated 10, and includes a base portion 12 and a plurality of teeth 14. The attachment comb 10 is preferably molded out of a suitable plastic material, although other materials and manufacturing methods are also considered as being within the scope of the invention. The base portion 12 of the attachment comb 10 may be constructed of any one of numerous different designs, as long as the design enables the attachment comb 10 to be securely attached to a hair clipper near the cutting blades in such a manner that the teeth 14 of the attachment comb 10 guide the hair towards the cutting blades when the hair clipper, with the attachment comb 10 in place, is slid across the surface of the head of the person receiving a haircut.

Figure 2:
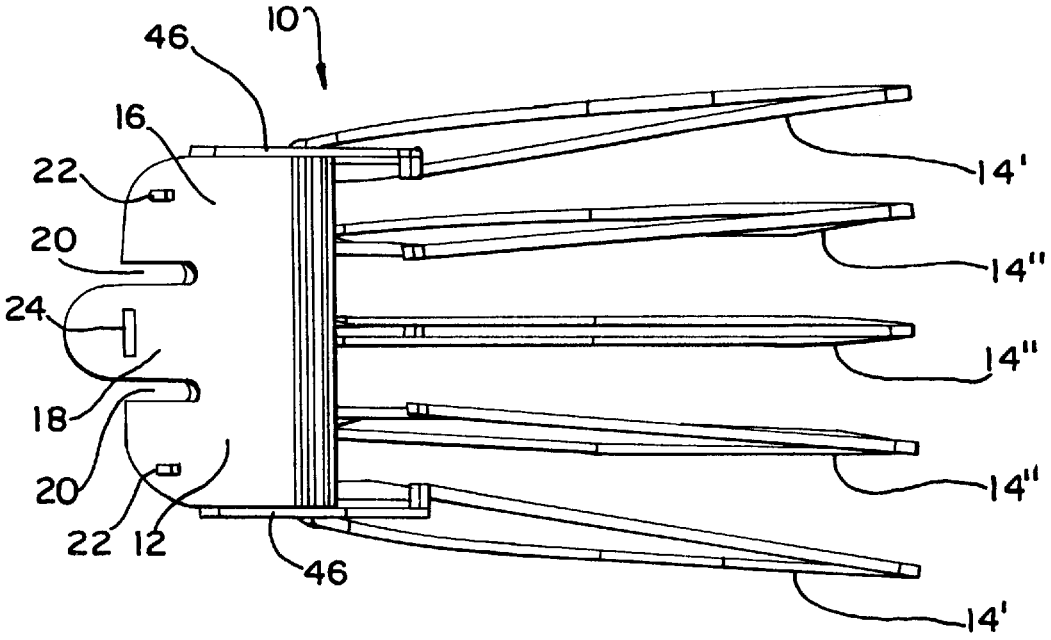
FIG. 2 is a top view of the present hair clipper attachment comb.

It is to be noted that the base portion 12 should be capable of securely maintaining the attachment comb 10 connected to the hair clipper, but the base portion 12 should also permit easy removal of the attachment comb 10 from the hair clipper when the operator wishes to either replace the attachment comb with another attachment comb of different configuration, or to use the hair clipper without an attachment comb. In the preferred embodiment, the base portion 12 is configured to accomplish these two goals through the inclusion of a horizontally extending portion 16 (see FIG. 4) and a tab 18 that extends from the horizontally extending portion 16 (see FIGS. 1–4). Surrounding the tab 18 are preferably two slots 20, which enable the tab 18 to be more flexible, which facilitates attachment of the comb 10 to the hair clipper. Positioned on the top surface of the horizontally extending portion 16 are several projections 22, and extending from the tab 18 is an elongated lip 24, as shown in FIGS. 1 and 2. The projections 22 and the elongated lip 24 are configured to cooperate with corresponding surfaces on the stationary blade of the hair clipper to secure the attachment comb 10 into an operative position.

Figure 4:
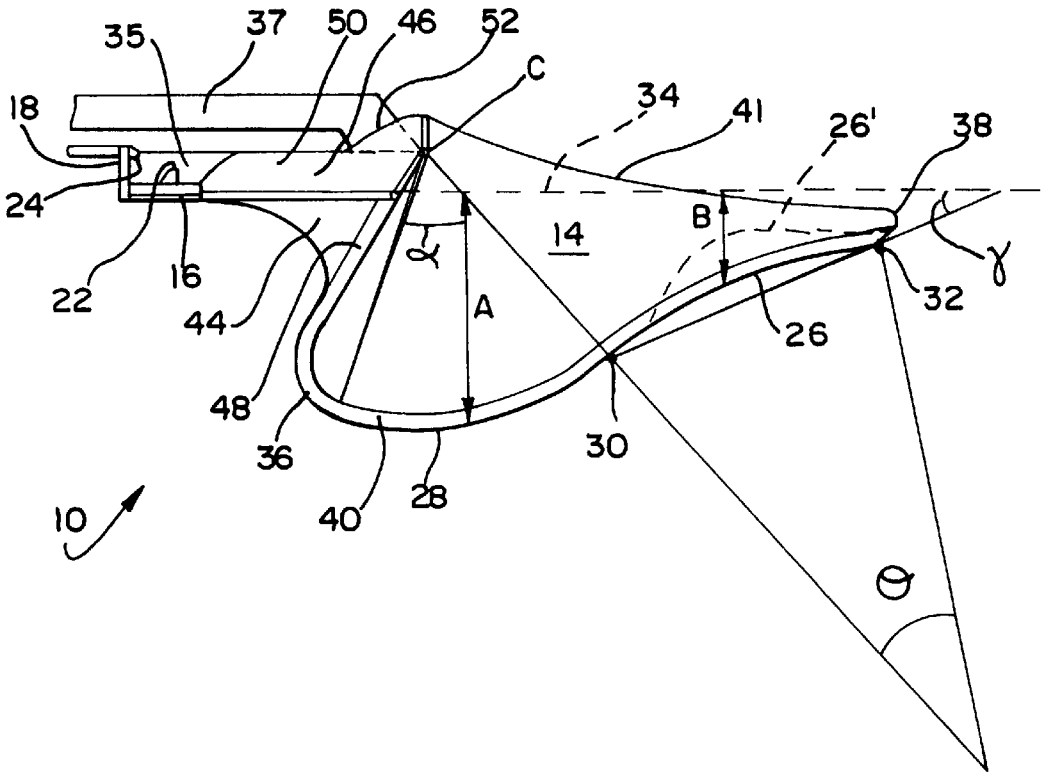
FIG. 4 is a side view of the present hair clipper attachment comb.
Figure 5:
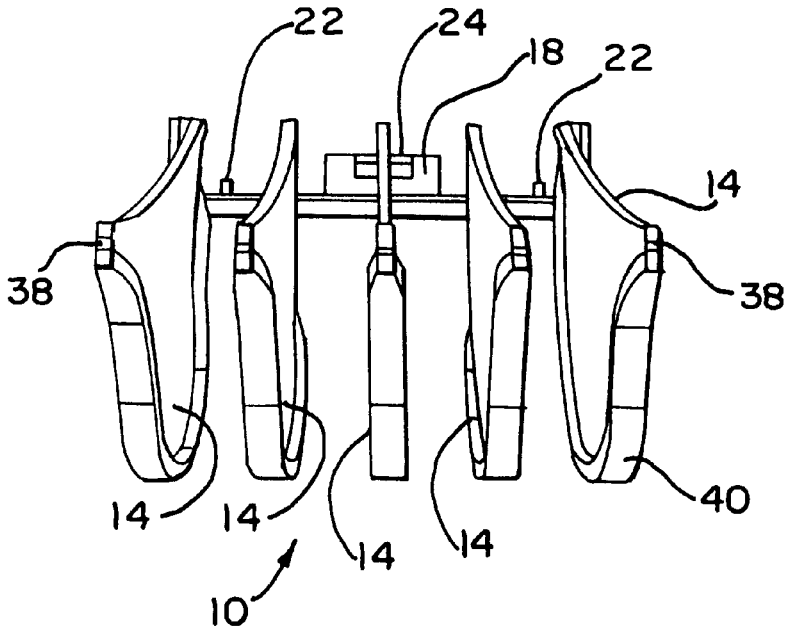
FIG. 5 is a front view of the present hair clipper attachment comb.
Figure 6:
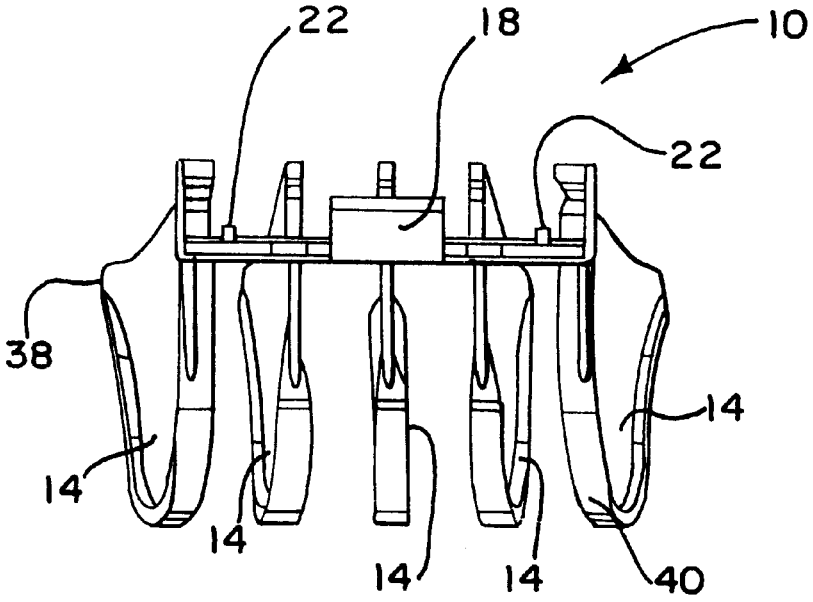
FIG. 6 is a rear view of the present hair clipper attachment comb.

Several important features of the present invention relate to the shape and configuration of the teeth 14. As shown in FIG. 4, the teeth 14 preferably each include a concave curved surface 26 located on a lower peripheral edge thereof near the distal end of each tooth. Because of the manner in which the clipper and attachment comb assembly is generally operated, positioning the concave curved surface 26 near the distal end of the tooth 14 necessarily means that this surface will be one of the first surfaces to contact the head of the person whose hair is being trimmed. This concave curved surface 26 is designed to conform to the surface of the head of the person whose hair is being clipped. It is contemplated that several different concave curves of different radii may be selected for different versions of the attachment comb, such as one version for children which includes a concave curved surface of a smaller radius than that of the concave curved surface of the adult version. The concave curved surface 26 enables the attachment comb 10 to smoothly guide the hair clipper along the surface of the head, and eliminates (or at least greatly reduces) the "rocking" motion that occasionally accompanies the use of attachment combs with flat lower peripheral surfaces. Thus, by reducing the "rocking motion," the concave curved surface 26 facilitates the cutting of the different strands of hair to a uniform length.

As also shown in FIG. 4, the lower peripheral surface of each of the teeth 14 also includes a convex curved surface 28 that is located between the concave curved surface 26 and the horizontally extending portion 16. As the attachment comb 10 glides along the surface of the head of the person whose hair is being trimmed, the convex curved surface 28 contacts the head after the concave curved surface 26, as mentioned earlier. This convex curved surface 28 maintains a uniform cutting length and also facilitates a smooth disengagement of the attachment comb 10 from the surface of the head of the person whose hair is being trimmed.

Experimentation has revealed that an attachment comb 10 including teeth 14 with the particular shape and dimensions discussed below satisfies at least one of the intended objectives of developing an attachment comb capable of comfortably clipping relatively long hair into a uniform length. The embodiment shown and discussed is one example of a configuration designed to uniformly cut hair to a length of approximately one and one half inches (hereinafter the 1½" embodiment). However, while reviewing the following discussion, it should be kept in mind that variations on the particular shape disclosed and the suggested dimensions are also contemplated as being within the scope of the present invention, as long as the primary objectives of the invention are accomplished. Additionally, it should also be kept in mind that the dimensions and configuration of the present invention can also be varied so that the resulting cut hair is of uniform predetermined lengths other than one and one half inches.

Concerning the curve of the concave curved surface 26, in the 1½" embodiment shown, it is suggested that the curve be based on an arc of an angle θ, which is created by a circle of a radius of approximately between 2 and 4 inches, and where θ is approximately between 30 and 40 degrees. Preferably, for the 1½ inch attachment comb, θ is approximately 35 degrees, and is based on a circle of a radius of approximately 3 inches.

In a contemplated variation of the standard 1½" embodiment, the concave curved surface 26 may also be formed as a shortened tooth, as shown in dashed lines in FIG. 4 by reduced radius surface 26'. The reduced radius surface 26' reduces the amount of material needed to manufacture the attachment comb 10, which reduces the cost of manufacture. However, use of the reduced radius surface 26' does not adversely affect the performance of the attachment comb 10 with regard to its ability to cut hair to a uniform length. In addition, the angle of inclination of the comb 10 with respect to the head is not altered by the reduced radius portion 26' because the scalp is still contacted at tangent points 30 and 32. One benefit of the configuration with a reduced radius portion 26' is that these teeth penetrate into a patch of hair more easily than the teeth with concave curved surfaces 26. The reduced radius surface 26' may be included on every tooth 14, or it may be included only on alternating teeth, such as that shown in dashed lines 26' in FIG. 1. It is also contemplated that the reduced radius surface 26' can be included only on the interior teeth (such as teeth 14" and 14'" shown in FIG. 3).

As an alternate way of measuring the concave curved surface 26 of the standard 1½" embodiment, an angle $\gamma$ can also be defined. The angle $\gamma$ is created between a line connecting the tangent points 30 and 32 of the outer limits of the concave curved surface 26 with a line 34, which is an extension of a line defined by the horizontally extending portion 16 of the base portion 12. The angle $\gamma$ in this embodiment is preferably between approximately 20 and 30 degrees, with about 25 degrees being chosen for the embodiment shown in FIG. 4.

Turning now to the convex curved surface 28, this surface is defined by an arc of an angle $\alpha$, with a center point C. The center point C is where the actual cutting takes place, as this is the point where the tips of the stationary blade 35 and the moving blade 37 meet. Thus, a circle of a radius of approximately 1½" is necessary as the basis for the arc of the angle $\alpha$ in the 1½" embodiment (where the hair is cut to a length of 1½ inches), which will maintain the cutting surface a distance of 1½ inches from the surface of the scalp. Of course, the attachment comb of the present invention may be modified to cut hair to other predetermined lengths, such as 1.75 inches, or 2 inches, etc., and such modified combs would include a corresponding radius of a circle of 1.75 inches, or 2 inches, etc.

In the 1½" embodiment, the angle $\alpha$ should be between approximately 40 and 50 degrees, with 45 degrees being the preferred angle. When the convex curved surface 28 and the concave curved surface 26 are viewed together from the side, as depicted in FIG. 4, they create a continuous curve which may be described generally as being of a half-teardrop shape.

Another important feature of the present invention is the dimensional relationship between the convex curved surface 28 and the concave curved surface 26. The actual and relative heights of the regions near these curved surfaces are important because they are one of the primary factors that determine the angle at which the hair clipper and attachment comb assembly approaches the scalp, i.e. the approach angle of the device. As shown in FIG. 4, a vertical height line indexed as "A" has been drawn between the center of the convex curved surface 28 and the horizontal line 34 that extends from the horizontally extending portion 16 of the base portion 12. In addition, a vertical height line indexed as "B" has been drawn between the center of the convex curved surface 26 to the horizonal line 34. In the 1½" embodiment shown, the length of line A is approximately 2.5 times as long as the length of line B, although ratios of the length of line A to the length of line B between one and four are also contemplated. In the 1½" embodiment shown in the figures, line A is approximately 1.25 inches and line B is approximately 0.5 inches. However, as previously discussed, alternate ratios and dimensions are also contemplated as being within the scope of the invention, especially when associated with attachment combs configured to cut hair to lengths other than 1½'.

Several features related to the teeth 14 have been added to increase the comfort of the person whose hair is being trimmed. For example, rounded edges 36 and 38 have been included near the proximal and distal ends, respectively, of each of the teeth 14. These rounded edges 36 and 38 are favored over blunt edges, which may jab or scratch the head of the haircutting subject, resulting in discomfort to that person.

In addition, in one embodiment, a widened rib 40 extends along the lower peripheral edge of each of the teeth 14 (see FIGS. 1 and 4). While these ribs 40 are shown to extend along the full length of the lower periphery of each tooth 14, it is also contemplated that the ribs 40 could extend only along part of the lower periphery of each tooth in the regions most likely to be pressed against the scalp during use, or that the ribs 40 could only be included on certain teeth, such as, for example, only being included on alternating teeth (such as on teeth 14' and 14" of FIG. 3) or only being included on the outer teeth (such as teeth 14' of FIG. 3). In the alternate embodiment of the teeth which includes the reduced radius surface 26' (as shown in FIGS. 1 and 4), the widened rib 40 may be terminated prior to the reduced radius surface 26', as this surface does not make contact with the scalp.

The ribs 40 are of a width that is greater than that of the rest of the body of the tooth 14 in order to better distribute the pressure that the tooth 14 creates when riding along the surface of the head. The widened lower surface of the rib 40 reduces the force on each contact point between the head and the attachment comb 10, when compared to a comb without widened ribs, because the forces are divided among a larger surface area. This reduction in contact pressure makes the cutting procedure more comfortable for the person whose hair is being cut. The width of each rib 40 should be in the range of approximately 0.06 to 0.20 inches, with 0.15 inches being the preferred dimension, while the width of the body portion of each tooth should be in the range of approximately 0.03 to 0.06 inches. Further, the width of the rib 40 is preferably approximately at least twice as wide as the body of the tooth 12.

In addition to the features previously described, the present attachment comb 12 also includes features which help to guide the hair towards the cutting blades found on the hair clipper. One feature related to guiding the hair is the longitudinal orientation of the teeth 14. As most clearly shown in FIGS. 2 and 3, the teeth 14', 14", and 14'" are preferably angled in an oblique manner with respect to each other to aid in funneling the hair towards the cutting blades of the hair clipper, which would be located toward the left-hand side of FIGS. 2 and 3. By flaring the teeth in this fashion, more hair spread out over a wider surface area can be cut with a single pass of the hair clipper. Additionally, flaring of the teeth also helps to better align the orientation of the strands of hair in preparation for being cut. When the teeth are flared, strands of hair that are aligned in many different directions are more likely to be contacted and aligned than if the teeth were simply arranged in parallel to each other. More specifically, strands of hair are contacted and aligned by the lifting surfaces 41 on the teeth 14, as shown in FIGS. 1 and 4.

However, it should be kept in mind that if the teeth are flared too much, it may be difficult to obtain the desired uniform length cut. Thus, in the 1½" embodiment, which has a number of teeth 14', 14", and 14'" that extend approximately three inches from the end of the base portion 12, it is suggested that the spacing between the teeth at the distal ends (i.e. the free ends) be approximately one and one half times wider that the spacing between the teeth at the corresponding proximal ends, which are near the base portion 12. Depending upon the overall length of the teeth, the suggested ratio of the widths of the spaces between the distal ends to the widths of the spaces at the proximal ends may be anywhere from about one and a quarter to about two and a half. It is also contemplated that the spacing between the distal ends of the teeth, as well as the spacing between the proximal ends, need not be uniform. For example, it is contemplated that the widths at the distal ends between the two outer teeth 14' and the two intermediate teeth 14" could be greater than the widths between the two intermediate teeth 14" and the central tooth 14'" (or vice versa).

In one preferred embodiment, the flared configuration of the teeth is also created by varying the angles of inclination for each tooth with respect to a longitudinal line. For example, it is suggested that the central tooth 14'" extend in a generally longitudinal direction from the base portion 12, that the intermediate teeth 14" extend at a first angle from the longitudinal direction, and that the outer teeth 14' extend at a second angle from the longitudinal direction, where the first angle is less than the second angle. In this manner, the proper proportions of hair can be guided toward the cutting blades of the hair clipper. It should also be noted that in the preferred embodiment of the attachment comb depicted in the figures, five teeth (14', 14", and 14'") are shown. However, other quantities of teeth may also create satisfactory performance.

Figure 3:
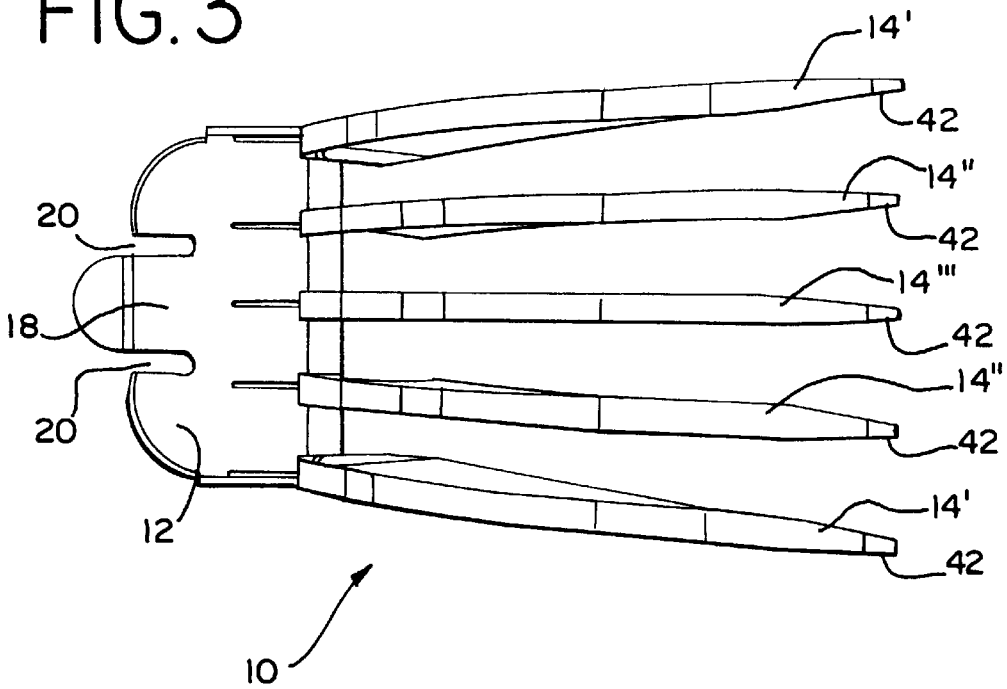
FIG. 3 is a bottom view of the present hair clipper attachment comb.

Another feature of the present invention that facilitates the use of the present invention is that the widened ribs 40 each taper to a reduced thickness portion 42 near their distal ends, as shown in FIG. 3. This reduced thickness portion 42 facilitates entry of the teeth 14 into a patch of hair.

Finally, the preferred embodiment of the present attachment comb also includes several features for increasing the overall strength of the attachment comb 10. As shown in FIGS. 1 and 4, a strengthening web 44 is included to strengthen the connection between each tooth 14 and the lower surface of the horizontally extending portion 16 of the base portion 12. In addition, each of the outer teeth 14 also includes a thickened shoulder 46 for adding additional strength in this area. Also, the ribs 40 may be extended up to an auxiliary length 48 (shown in FIGS. 1 and 4) which does not contact the scalp of the haircutting subject. Thus, this auxiliary length rib 48 is not being provided for the comfort of the subject, but is instead primarily provided to strengthen and add rigidity to the tooth 14 in this area.

In addition to providing added rigidity and strength, the thickened shoulders 48 also serve to ensure that the attachment comb 10 is properly aligned with respect to the hair clipper, and especially with respect to the cutting blades (i.e., the oscillating blade and the stationary blade). If the attachment comb is not properly aligned in the transverse direction with respect to the cutting blades, the oscillating blade may cut away at the outer teeth 14'. However, inclusion of the thickened shoulders 48 substantially eliminates this problem because the thickened shoulders 48 abut against the side edges of the stationary blade to prevent misalignment. In a preferred embodiment, each of the thickened shoulders includes a substantially straight portion 50 and an inclined portion 52. The top of the substantially straight portion 50 should extend generally along the top surface of the stationary blade, and the top of the inclined portion 52 should extend above the top of the stationary blade, which helps to better secure the position of the attachment comb 10.

In operation, the attachment comb 10 of the present invention is first secured to the hair clipper via the base portion 12. Once the attachment comb 10 is in place, the hair trimmer is turned on, and the hair trimmer, with attachment comb 10 in place, is guided over the head of the subject about to receive a haircut. Hair cutting usually begins at one end of the hairline, for example at the forehead, and using long strokes, lines of hair are trimmed as the teeth 14 guide the hair trimmer over the subject's head. Because of the double curved configuration (including the concave curved surface 26 and the concave curved surface 28), and also because of the widened ribs 40, the hair in a line below the path of the hair trimmer is cut to a uniform length with little or no discomfort. At the opposite hairline (for example at the back of the neck), or wherever else is convenient for the hair cutter, the attachment comb 10 and hair clipper are disengaged from the subject's head, and another line of hair is trimmed. This process is repeated until the hair on the subject's entire head is trimmed, or until whatever portion of the hair that is desired to be trimmed is completed.

While a particular embodiment of the attachment comb of the present invention has been shown and described, it will be appreciated by those skilled in the art that changes and modifications may be made thereto without departing from the invention in its broader aspects and as set forth in the following claims.

What is claimed is:

1. An attachment comb for use with a hair clipper comprising:

a base portion configured and arranged for attaching the attachment comb to a hair clipper, said base portion extending between a front edge, a rear edge, and two outer side edges to define a generally horizontal plane;

a plurality of teeth extending from said base portion, said plurality of teeth being arranged generally perpendicularly to said generally horizontal plane of said base portion, said plurality of teeth including a pair of outer teeth and at least one intermediate tooth; and a thickened shoulder extending at least partially along each of said outer side edges of said base portion, and further extending to meet each of said outer teeth, whereby said thickened shoulders cooperate to properly align said attachment comb with respect to the hair clipper, wherein each of said thickened shoulders is defined by a generally planer wall that extends generally upwardly from said outer side edge of said base portion in a generally perpendicular direction to said generally horizontal plane, further wherein said thickened shoulders are configured and arranged to surround a stationary blade of the hair clipper to ensure that said attachment comb is transversely aligned with respect to the stationary blade so that an oscillating blade of the hair clipper is restricted from contacting said attachment comb, and still further wherein each of said thickened shoulders includes a substantially straight portion extending generally parallel to said generally horizontal plane and an inclined portion that extends obliquely to said generally horizontal plane.

2. An attachment comb for use with a hair clipper comprising:

a base portion configured and arranged for attaching the attachment comb to a hair clipper;

a plurality of teeth extending from said base portion, said plurality of teeth each including a body portion defined between an upper peripheral edge and a lower peripheral edge, whereby at least a portion of said lower peripheral edges of said teeth are configured and arranged to make sliding contact with a head of a person whose hair is being clipped; and at least one widened rib portion extending along at least a portion of the length of at least one of said lower peripheral edges of said plurality of teeth, said at least one widened rib portion being generally wider than said body portion of said teeth, and whereby said at least one widened rib portion is configured and arranged to make sliding contact with the head of the person whose hair is being clipped.

3. The attachment comb as defined in claim 2 wherein said body portion of each of said plurality of teeth includes a tall portion and a short portion, as defined relative to said upper and lower peripheral edges, wherein said tall portions are configured and arranged with respect to a cutting area of the hair clipper such that the attachment comb is capable of lifting relatively long strands of hair away from the surface of the head of the person whose hair is being trimmed to produce trimmed hair of a substantially uniform length of at least one inch.

4. The attachment comb as defined in claim 2 wherein each of said plurality of teeth includes said rib portion thereon.

5. The attachment comb as defined in claim 2 wherein only alternating teeth of said plurality of teeth include said rib portion thereon.

6. The attachment comb as defined in claim 2 wherein said lower peripheral edge of said tooth extends to a length, defined as an auxiliary length, above where said sliding contact with a head is made, and wherein said rib portion is located at least on said auxiliary length, whereby said rib portion on said auxiliary length provides added rigidity to said tooth.

7. The attachment comb as defined in claim 2 wherein at least some of said lower peripheral edges of said plurality of teeth define curved portions that are curved to correspond, at least in part, to a curvature of a surface upon which the hair clipper is intended to be used, and further wherein said rib portion is located at least on said curved portions.

8. The attachment comb as defined in claim 2 wherein each of said plurality of teeth includes a proximal end near said base portion and a distal end at an opposite end thereof, and further wherein each of said lower peripheral edges includes a concave curved surface near said distal end and a convex curved surface near said proximal end.

9. The attachment comb as defined in claim 8 wherein said concave curved surface is defined by an arc of approximately between 30 and 40 degrees of a circle with a radius of approximately between 2 and 4 inches and said convex curved surface is defined by an arc of approximately between 40 and 50 degrees of a circle with a radius of approximately between 1 and 2 inches.

10. The attachment comb as defined in claim 8 wherein said concave curved surfaces on said plurality of said teeth are not all of a uniform radius, whereby some of said teeth include a concave curved surface of a first radius and the remainder of said teeth include a concave curved surface of a second radius which is greater than said first radius.

11. The attachment comb as defined in claim 10 wherein said rib portion does not extend to said concave curved surface of said teeth with a concave curved surface of said first radius.

12. The attachment comb as defined in claim 8 wherein said base portion includes a generally horizontally extending portion and further wherein a vertical height perpendicular to said horizontally extending portion taken from a central area of said convex curved surface is at least twice as great as a vertical height perpendicular to said horizontally extending portion taken from a central area of said concave curved surface.

13. The attachment comb as defined in claim 2 wherein said base portion includes a generally horizontally extending portion with a tab extending therefrom, and surrounding said tab on either side thereof is a slot cut into said horizontally extending portion.

14. The attachment comb as defined in claim 2 wherein at least one of said plurality of teeth includes a strengthening web located thereon, further wherein said strengthening web extends between said body portion of said tooth and said base portion.

15. An attachment comb for use with a hair clipper comprising:

a base portion configured and arranged for attaching the attachment comb to a hair clipper;

a plurality of teeth extending from said base portion, said plurality of teeth each including a body portion defined between an upper peripheral edge and a lower peripheral edge, whereby at least a portion of said lower peripheral edges of said teeth are configured and arranged to make sliding contact with a head of a person whose hair is being clipped; and wherein each of said plurality of teeth includes a proximal end near said base portion and a distal end at an opposite end thereof, and further wherein each of said lower peripheral edges includes a concave curved surface near said distal end.

16. The attachment comb as defined in claim 15 wherein said concave curved surfaces are of at least two different radii, whereby some of said teeth include a concave curved surface of a first radius and some of said teeth include a concave curved surface of a second radius which is greater than said first radius.

17. The attachment comb as defined in claim 16 wherein each of said concave curved surfaces of said second radius are curved to correspond, at least in part, to a curvature of a surface upon which the hair clipper is intended to be used.

18. The attachment comb as defined in claim 16 wherein said plurality of teeth includes five teeth consisting of a pair of outer teeth, one center tooth, and a pair of intermediate teeth positioned between said center tooth and one tooth of said pair of outer teeth; and further wherein said pair of intermediate teeth each include a concave curved surface of said first radius and said center tooth and said pair of outer teeth each include a concave curved surface of said second radius.

19. The attachment comb as defined in claim 16 wherein at least some of said lower peripheral edges of said teeth include a widened rib portion on at least a portion thereof, and further wherein said widened rib portion does not extend along said concave curved surfaces which are of said first radius.

20. An attachment comb for use with a hair clipper comprising:

a base portion configured and arranged for attaching the attachment comb to a hair clipper;

a plurality of teeth extending from said base portion, said plurality of teeth each including a body portion defined between an upper peripheral edge, a lower peripheral edge, a proximal end located near said base portion and a distal end located at an opposite end thereof; and wherein said plurality of teeth are angled in an oblique manner with respect to each other for aligning and guiding hair towards the hair clipper.

21. The attachment comb defined in claim 20 wherein said plurality of teeth flare outwardly from each other such that spaces between said distal ends are wider than spaces between said corresponding proximal ends, and further wherein said spaces between said distal ends are approximately one and one half times wider than said spaces between said corresponding proximal ends.

22. The attachment comb defined in claim 20 wherein said plurality of teeth includes a pair of outer teeth, at least one center tooth, and at least one pair of intermediate teeth positioned between said at least one center tooth and one tooth of said pair of outer teeth; and further wherein said center tooth extends generally in a longitudinal direction, said intermediate teeth extend generally at a first angle to said longitudinal direction, and said outer teeth extend generally at a second angle to said longitudinal direction, where said first angle is less than said second angle.

23. The attachment comb defined in claim 20 wherein each of said lower peripheral edges of said teeth includes a rib of a width greater than that of said body portion.

24. An attachment comb for use with a hair clipper, said attachment comb comprising:

a base portion configured and arranged for attaching the attachment comb to a hair clipper;

a plurality of teeth extending from said base portion, said plurality of teeth each including a body portion defined between an upper peripheral edge, a curved lower peripheral edge configured and arranged to make sliding contact with a head of a person whose hair is being clipped, a proximal end located near said base portion, and a distal end located at an opposite end thereof, wherein said plurality of teeth flare outwardly from each other such that spaces between said distal ends are greater than spaces between said corresponding proximal ends;

a widened rib extending substantially along the length of each of said lower peripheral edges of said plurality of teeth, said widened rib further including a substantially flat bottom surface; and a pair of thickened shoulders extending from opposite edges of said base portion to a pair of said plurality of teeth, said pair of thickened shoulders being configured and arranged for aligning said attachment comb with respect to the hair clipper.

25. The attachment comb defined in claim 24 wherein each of said curved lower peripheral edges of said plurality of teeth is curved in a half-teardrop shape that includes a convex portion positioned near said proximal end and a concave portion positioned near said distal end.

26. The attachment comb defined in claim 25 wherein said base portion includes a generally horizontally extending portion and said half-teardrop shape includes a tall portion that tapers to a short portion; and further wherein a vertical height perpendicular to said horizontally extending portion taken from a central area of said tall portion is at least twice as great as a vertical height perpendicular to said horizontally extending portion taken from a central area of said short portion, whereby relatively long strands of hair may be lifted away from the surface of a head of a person whose hair is being trimmed.

* * * * *